US007340210B2

(12) United States Patent
Tsueda et al.

(10) Patent No.: US 7,340,210 B2
(45) Date of Patent: Mar. 4, 2008

(54) HEAT ROLLER AND FIXING APPARATUS

(75) Inventors: Yoshinori Tsueda, Fuji (JP); Satoshi Kinouchi, Tokyo (JP); Osamu Takagi, Chofu (JP); Toshihiro Sone, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 264 days.

(21) Appl. No.: 11/082,218

(22) Filed: Mar. 17, 2005

(65) Prior Publication Data

US 2006/0210332 A1 Sep. 21, 2006

(51) Int. Cl.
*G03G 15/20* (2006.01)

(52) U.S. Cl. ..... 399/333

(58) Field of Classification Search ..... 399/122, 399/320, 328, 330, 331, 332, 333, 336
See application file for complete search history.

(56) References Cited

U.S. PATENT DOCUMENTS

| | | | | |
|---|---|---|---|---|
| 6,026,273 | A | 2/2000 | Kinouchi et al. | |
| 6,078,781 | A | 6/2000 | Takagi et al. | |
| 6,087,641 | A | 7/2000 | Kinouchi et al. | |
| 6,097,926 | A | 8/2000 | Takagi et al. | |
| 6,137,985 | A | 10/2000 | Kinouchi et al. | |
| 6,154,629 | A | 11/2000 | Kinouchi et al. | |
| 6,337,969 | B1 | 1/2002 | Takagi et al. | |
| 6,415,128 | B1 | 7/2002 | Takagi et al. | |
| 6,438,335 | B1 | 8/2002 | Kinouchi et al. | |
| 6,643,476 | B1 | 11/2003 | Kinouchi et al. | |
| 6,643,491 | B2 | 11/2003 | Kinouchi et al. | |
| 6,724,999 | B2 | 4/2004 | Kikuchi et al. | |
| 6,725,000 | B2 | 4/2004 | Takagi et al. | |
| 6,763,206 | B2 | 7/2004 | Kinouchi et al. | |
| 6,782,232 | B2 * | 8/2004 | Hayami et al. | 399/328 |
| 6,861,627 | B2 | 3/2005 | Wasai et al. | |
| 6,861,630 | B2 | 3/2005 | Kinouchi et al. | |
| 6,868,249 | B2 | 3/2005 | Kinouchi et al. | |
| 6,871,041 | B2 | 3/2005 | Takagi et al. | |
| 6,889,018 | B2 | 5/2005 | Kinouchi et al. | |
| 6,898,409 | B2 | 5/2005 | Tsueda et al. | |
| 6,900,419 | B2 | 5/2005 | Takagi et al. | |
| 2004/0086306 | A1 * | 5/2004 | Edahiro et al. | 399/328 |

(Continued)

FOREIGN PATENT DOCUMENTS

JP 2002-213434 A 7/2002

(Continued)

OTHER PUBLICATIONS

U.S. Appl. No. 10/378,859, filed Mar. 5, 2003, Sone et al.

(Continued)

*Primary Examiner*—Hoan Tran
(74) *Attorney, Agent, or Firm*—Foley & Lardner LLP

(57) ABSTRACT

A fixing apparatus is provided with a heat roller 2 which includes an elastic member 2*b* having an outer diameter which is different from another one in an axial direction, and a conductive layer 2*c* provided outside of the elastic member 2*b*, wherein a maximum outer diameter and a minimum outer diameter of the elastic member 2*b* has a difference therebetween ranging from 0.2 mm to 3.0 mm.

10 Claims, 3 Drawing Sheets

U.S. PATENT DOCUMENTS

| | | | |
|---|---|---|---|
| 2004/0238531 | A1 | 12/2004 | Kikuchi et al. |
| 2004/0265021 | A1 | 12/2004 | Kinouchi et al. |
| 2005/0008413 | A1 | 1/2005 | Takagi et al. |
| 2006/0210291 | A1 | 9/2006 | Kinouchi et al. |
| 2006/0210292 | A1 | 9/2006 | Kinouchi et al. |

FOREIGN PATENT DOCUMENTS

| | | | |
|---|---|---|---|
| JP | 2002-295452 | A | 10/2002 |

OTHER PUBLICATIONS

U.S. Appl. No. 10/799,770, filed Mar. 15, 2004, Kikuchi et al.
U.S. Appl. No. 10/805,305, filed Mar. 22, 2004, Sone et al.
U.S. Appl. No. 10/805,308, filed Mar. 22, 2004, Tsueda et al.
U.S. Appl. No. 10/805,420, filed Mar. 22, 2004, Sone et al.
U.S. Appl. No. 10/805,507, filed Mar. 22, 2004, Kikuchi et al.
U.S. Appl. No. 10/805,514, filed Mar. 22, 2004, Kinouchi et al.
U.S. Appl. No. 10/805,522, filed Mar. 22, 2004, Kikuchi et al.
U.S. Appl. No. 10/806,392, filed Mar. 23, 2004, Takagi et al.
U.S. Appl. No. 10/820,138, filed Apr. 8, 2004, Sone et al.
U.S. Appl. No. 10/944,707, filed Sep. 21, 2004, Sone et al.
U.S. Appl. No. 10/944,855, filed Sep. 21, 2004, Sone et al.
U.S. Appl. No. 10/945,395, filed Sep. 21, 2004, Kinouchi et al.
U.S. Appl. No. 11/078,421, filed Mar. 14, 2005, Takagi et al.
U.S. Appl. No. 11/078,725, filed Mar. 14, 2005, Takagi et al.
U.S. Appl. No. 11/078,726, filed Mar. 14, 2005, Tsueda et al.
U.S. Appl. No. 11/080,833, filed Mar. 16, 2005, Tsueda et al.
U.S. Appl. No. 11/080,943, filed Mar. 16, 2005, Sone et al.
U.S. Appl. No. 11/082,198, filed Mar. 17, 2005, Sone et al.
U.S. Appl. No. 11/082,242, filed Mar. 17, 2005, Sone et al.

* cited by examiner

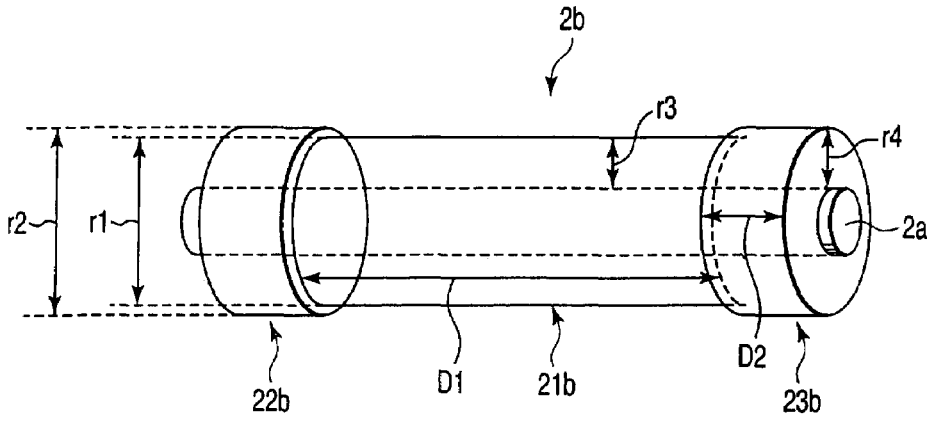

FIG. 2

| Type | Hardness (degree) | Thickness (mm) | Diameter difference | 0.0 | 0.2 | 0.4 | 0.8 | 1.0 | 1.6 | 2.0 | 2.5 | 3.0 | 3.5 |
|---|---|---|---|---|---|---|---|---|---|---|---|---|---|
| A | 25 | 3.0 | Image failure | × | × | ○ | ○ | ○ | ○ | ○ | ○ | ○ | ○ |
| | | | Paper wrinkle | ○ | ○ | ○ | ○ | ○ | ○ | ○ | × | × | × |
| B | 25 | 5.0 | Image failure | × | × | ○ | ○ | ○ | ○ | ○ | ○ | ○ | ○ |
| | | | Paper wrinkle | ○ | ○ | ○ | ○ | ○ | ○ | ○ | × | × | × |
| C | 25 | 7.5 | Image failure | × | × | ○ | ○ | ○ | ○ | ○ | ○ | ○ | ○ |
| | | | Paper wrinkle | ○ | ○ | ○ | ○ | ○ | ○ | ○ | ○ | × | × |
| D | 35 | 3.0 | Image failure | × | ○ | ○ | ○ | ○ | ○ | ○ | ○ | ○ | ○ |
| | | | Paper wrinkle | ○ | ○ | ○ | ○ | ○ | ○ | ○ | × | × | × |
| E | 35 | 5.0 | Image failure | × | ○ | ○ | ○ | ○ | ○ | ○ | ○ | ○ | ○ |
| | | | Paper wrinkle | ○ | ○ | ○ | ○ | ○ | ○ | ○ | ○ | × | × |
| F | 35 | 7.5 | Image failure | × | × | ○ | ○ | ○ | ○ | ○ | ○ | ○ | ○ |
| | | | Paper wrinkle | ○ | ○ | ○ | ○ | ○ | ○ | ○ | ○ | ○ | × |
| G | 45 | 3.0 | Image failure | × | ○ | ○ | ○ | ○ | ○ | ○ | ○ | ○ | ○ |
| | | | Paper wrinkle | ○ | ○ | ○ | ○ | ○ | ○ | ○ | × | × | × |
| H | 45 | 5.0 | Image failure | × | ○ | ○ | ○ | ○ | ○ | ○ | ○ | ○ | ○ |
| | | | Paper wrinkle | ○ | ○ | ○ | ○ | ○ | ○ | ○ | ○ | × | × |
| I | 45 | 7.5 | Image failure | × | × | ○ | ○ | ○ | ○ | ○ | ○ | ○ | ○ |
| | | | Paper wrinkle | ○ | ○ | ○ | ○ | ○ | ○ | ○ | ○ | ○ | × |

FIG. 3

| Outer diameter difference | Hardness before heated | Hardness after heated (maximum) |
|---|---|---|
| 0.8 | 63 | 71 |
| 1.0 | 65 | 72 |
| 1.6 | 57 | 67 |
| 2.0 | 57 | 68 |
| 0 (no countermeasure is taken) | 69 | 78 |
FIG. 4
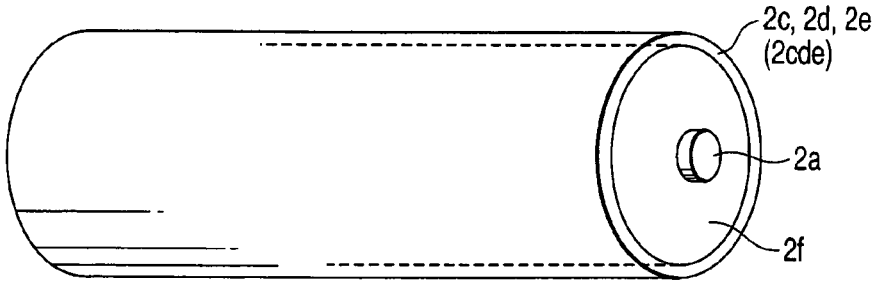
FIG. 5
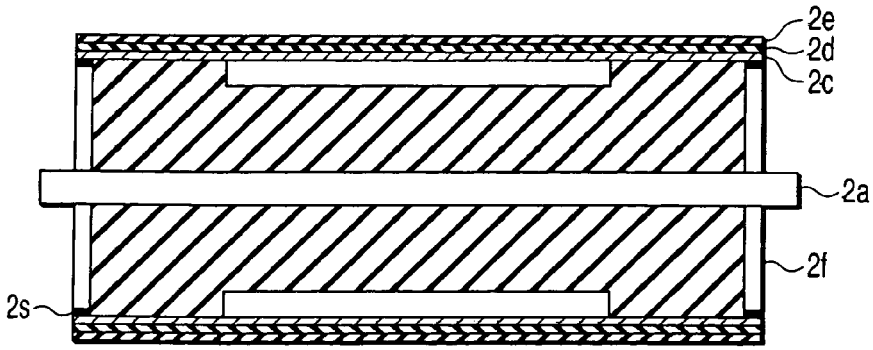
FIG. 6

HEAT ROLLER AND FIXING APPARATUS

BACKGROUND OF THE INVENTION

The present invention relates to a fixing apparatus for fixing a developer image onto paper, and more particularly to a fixing apparatus utilizing an inductive heating method.

An image forming apparatus utilizing a digital technology, for example, an electronic copying machine has a fixing apparatus for applying a pressure onto a developer image melted by heating, thereby fixing the image onto paper.

The fixing apparatus comprises: a heat roller for melting a developer, for example, a toner; and a pressure roller for applying a predetermined pressure to the heat roller, wherein a predetermined contact width (nip width) is formed in a contact region (nip portion) between the heat roller and the pressure roller. On the paper passing though the nip portion, the developer image on the paper melted by a heat from the heat roller is fixed by a pressure from the pressure roller. In recent years, there has been utilized an inductively driven heating apparatus in which a thin film metal conductive layer is formed at the outside of the heat roller, and the metal conductive layer is heated by utilizing inductive heating.

For example, as disclosed in Jpn. Pat. Appln. KOKAI Publication No. 2002-295452, there is known a roller which comprises electricity and heat insulating property, the roller being applicable to a roller which is excellent in heat insulating property, which is fast in rising during heating, and which requires elasticity, and a heating apparatus using the roller.

In addition, in Jpn. Pat. Appln. KOKAI Publication No. 2002-213434, there is disclosed a technique for broadening a non-offset region which is a range of a fixing temperature, the technique being capable of sufficiently greatly forming a nip width which is a contact length between a heat roller and a pressure roller in a transport direction of recording paper, and obtaining a fixing image with a good quality on which a toner is sufficiently fused onto the recording paper, and is not released therefrom.

If the nip width formed at the nip portion between the heat roller and the pressure roller is not sufficiently allocated, there is a problem that a good image is not formed.

BRIEF SUMMARY OF THE INVENTION

According to an aspect of the present invention, there is provided a heat roller comprising:

an elastic member formed in a cylindrical shape and having a difference between a maximum outer diameter and a minimum outer diameter ranging from 0.2 mm to 3.0 mm; and a conductive layer allocated outside of the elastic member.

According to another aspect of the present invention, there is provided a heat roller comprising:

an elastic member formed in a cylindrical shape and allocated on an outer periphery face of a shaft member;

a conductive layer allocated on an outer periphery face of the elastic member; and a filter allocated at both ends in an axial direction of the elastic member, the filter sealing the elastic member together with the shaft member and the conductive layer.

According to further another aspect of the present invention, there is provided a fixing apparatus comprising:

a heat roller which includes: an elastic member including a center portion having a minimum outer diameter and end portions allocated at both ends of the center portion, the end portions each having a maximum outer diameter; and a conductive layer allocated on an outer periphery face of the elastic member, surface hardness during heating and surface hardness during non-heating being different from each other;

a pressure roller pressed against the heat roller by a pressurizing mechanism; and a heating mechanism which utilizes inductive heating to heat the metal conductive layer.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIG. 2 is a schematic view showing an example of a heat roller shown in FIG. 1;

FIG. 3 is a chart showing a result of a quality test of the heat roller shown in FIG. 2;

FIG. 4 is a chart showing a result of a hardness change test by heating the heat roller shown in FIG. 2;

FIG. 5 is a sectional view adopted to explain another example of the heat roller shown in FIG. 1; and FIG. 6 is a sectional view of the heat roller 2 shown in FIG. 5.

DETAILED DESCRIPTION OF THE INVENTION

Figure 1:
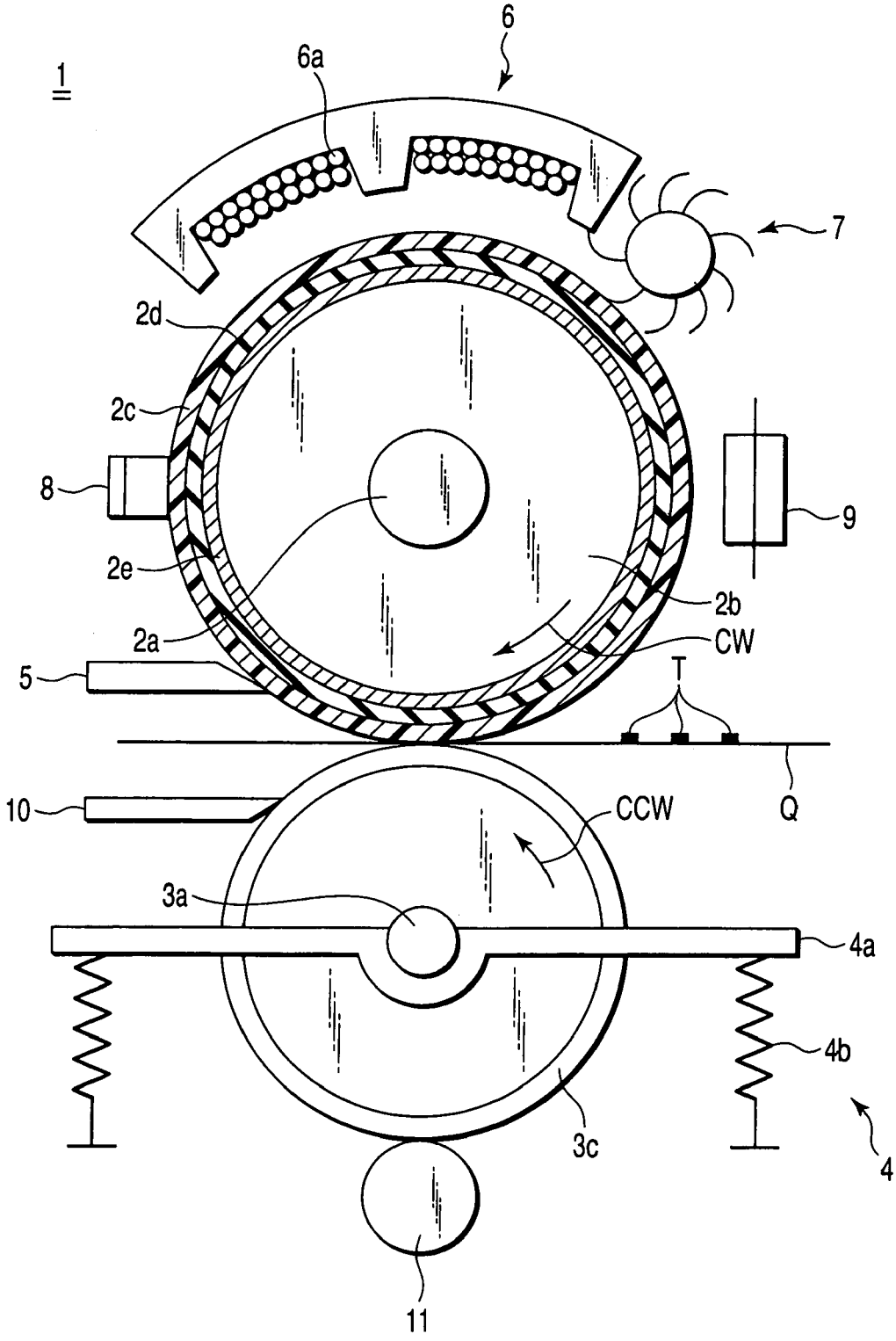
FIG. 1 is a schematic view showing an example of a fixing apparatus according to the present invention.

Hereinafter, embodiments of the present invention will be described with reference to the accompanying drawings.

FIG. 1 shows an example of a fixing apparatus 1 according to the present invention.

As shown in FIG. 1, the fixing apparatus 1 has a heating member (heat roller) 2 for heating a toner T on paper Q, and a pressurizing member (pressure roller) 3 for applying a predetermined pressure to the heat roller 1.

The heat roller 2 has: a shaft member 2*a* fixed at a predetermined position of the fixing apparatus 1; a first elastic layer 2*b* (hereinafter, referred to as an elastic member) allocated around the shaft member; a metal conductive layer 2*c*; a second elastic layer 2*d*; and a mold release layer 2*e*, wherein rotation is carried out by a drive motor (not shown) in a clockwise (CW) direction indicated by the arrow. With rotation of the heat roller 2, the pressure roller 3 is rotated in a counterclockwise (CCW) direction indicated by the arrow.

In the present embodiment, the elastic member 2*b* is composed of, for example, a foam rubber made by foaming a silicon rubber or the like. In addition, the metal conductive layer 2*c* is composed of aluminum, nickel, iron or the like in order of several microns in thickness. The second elastic layer 2*d* is composed of a heat resistance adhesive containing, for example, silicon in order of several microns in thickness, and has contact strength between the metal conductive layer 2*c* and the mold release layer. The mold release layer 2*e* is formed at the outermost peripheral portion having thickness of about 30 μm, and is composed of a fluorine resin (PFA or PTFE (polytetrafluoride ethylene), or a mixture of PFA and PTFE). In addition, the heat roller 2 is formed in outer diameter 45 mm.

The pressure roller 3 includes a shaft member 3*a*, an elastic member (for example, silicon rubber) allocated at the outside of the shaft member, and a mold release layer (for example, fluorine rubber) 3*c*. In a pressurizing mechanism (pressure applying mechanism) 4, the pressure roller 3 is pressed against the heat roller 2 by a pressurizing spring 4*b* via a bearing member 4*a* connected to the shaft member 3*a*. In this manner, at a contact portion between the heat roller 2 and the pressure roller 3, a nip portion having a predetermined width (nip width) or more is formed in the transport direction of paper P.

At the periphery of the heat roller 2, there are provided sequentially in a rotation direction at a downward side in a rotation direction from a nip portion between the heat roller 2 and the pressure roller 3: a releasing blade 5 for releasing paper Q; an induction heating device 6 including an energizing coil 6*a* and providing a predetermined magnetic field to the metal conductive layer 2*c* of the heat roller 2; and a cleaning member 7 for removing dust such as offset toner or paper chips adhered to the heat roller 2. In addition, in a longitudinal direction of the heat roller 2, there are allocated: a thermister 8 for detecting a temperature of the heat roller 2; and a thermostat 9 for sensing a failure of a surface temperature of the heat roller 2, thereby stopping power supply for heating the heat roller 2. It is preferable that a plurality of thermisters 8 are provided in the longitudinal direction of the heat roller 2, and that at least one or more thermostats 9 are provided in the longitudinal direction of the heat roller 2.

A releasing blade 10 for releasing the paper Q from the pressure roller 3 and a cleaning member 11 for removing the toner adhered to the pressure roller 3 are provided at the periphery of the pressure roller 3.

When a high frequency current is applied from an energizing circuit (inverter circuit) (not shown) to the energizing coil 6*a* of the induction heating device 6, a predetermined magnetic field is generated from the energizing coil 6*a*, and an eddy current flows the metal electrically conducing layer 2*c* of the heat roller 2. Then, a Joule heat is generated at a resistor of the metal conductive layer 2*c*, and the heat roller 2 generates a heat.

The paper Q to which a toner T adheres passes through the nip portion between the heat roller 2 and the pressure roller 3, and a predetermined pressure is applied by the pressure roller 3, whereby the toner T melted by the heat from the heat roller 2 is fixed to the paper Q.

In this manner, according to the fixing apparatus of the invention, the metal conductive layer 2*c* formed on the outer periphery face of the heat roller 2 is heated by utilizing inductive heating. Thus, a heat loss is reduced, energy efficiency is improved, and the heat roller 2 can be heated up to a predetermined temperature in a short time.

FIRST EMBODIMENT

Now, with reference to FIGS. 1, 2, 3 and 4, an example of a heat roller applied to the heat roller 2 shown in FIG. 1 will be described in detail. FIG. 2 is a schematic view showing a heat roller 2 which can be applied to the present embodiment. FIG. 3 is a chart showing a detection result of an image quality level or paper wrinkle of paper Q according to the hardness, thickness, and diameter difference of an elastic member of the heat roller 2 shown in FIG. 2. FIG. 4 is a chart showing a detection result of the surface hardness during heating and the surface hardness during non-heating, of the heat roller 2 shown in FIG. 2.

As shown in FIG. 2, the elastic member 2*b* includes: a center portion 21*b* having a minimum outer diameter "r1"; and end portions 22*b*, 23*b* positioned at both sides of the center portion 21*b*, each of which has a maximum outer diameter "r2". Namely, the elastic member 2*b* has an outer diameter which is different from another one in an axial direction. The member 2*b* is disclosed in the prior U.S. patent application Ser. No. 10/886,703 filed Jul. 9, 2004, the entire contents of which are incorporated herein by reference.)

The center portion 21*b* is formed in length D1 and thickness "r3" in the axial direction. The end portions 22*b*, 23*b* each are formed in length D2 and thickness "r4" in the axial direction. In addition, the elastic member 2*b* is formed on the shaft member 2*a* having a predetermined outer diameter in the axial direction. Thus, the thickness "r3" of the center portion 21*b* is smaller than the thickness "r4" of the end portions 22*b*, 23*b* each.

The elastic member 2*b* can be formed by applying a foam-added clay shaped silicon rubber to a primer-coated axial member 2*a* and foaming the rubber in a sponge shape. For example, an elastic member 2*b* having desired hardness and thickness can be formed by selecting a foaming rate, a material or the like.

Then, the elastic member 2*b* has a difference between the minimum outer diameter "r1" and the maximum outer diameter "r2" such that a predetermined or more nip width is allocated, good image forming can be executed, and no paper wrinkle is formed. In more detail, as shown in FIG. 3, the elastic member 2*b* has a difference between the minimum outer diameter "r1" and the maximum outer diameter "r2" within the range from 0.2 mm to 3.0 mm by changing the hardness and thickness. FIG. 3 shows a result of a "quality test" of the elastic member 2*b* having different settings. In the "quality test" used here, samples of the elastic members 2*b* are prepared, the elastic member of discriminated types A to I having predetermined thickness (3.0 mm to 7.5 mm) and predetermined hardness (25 degrees to 45 degrees), the elastic members each having a predetermined outer diameter difference (0.0 mm to 3.5 mm) corresponding to each of the types A to I; these samples are incorporated in the fixing apparatus 1; and an image is formed on the paper Q.

As shown in FIG. 3, a good quality image was formed and no wrinkle was formed as long as the hardness is 35 degrees or 45 degrees, the thickness is 3.0 mm or 3.5 mm, a difference between the minimum outer diameter "r1" and the maximum outer diameter "r2" of the elastic member 2*b* ranges from 0.2 mm to 2.0 mm. A good quality image was formed no wrinkle was formed as long as the hardness is 35 degrees or 45 degrees, the thickness is 5.0 mm or 7.5 mm, and a difference of the minimum outer diameter "r1" and the maximum outer diameter "r2" of the elastic member 2*b* ranges from 0.4 mm to 2.5 mm. A good quality image was formed no wrinkle was formed as long as the hardness is 35 degrees or 45 degrees, the thickness is 7.5 mm, and a difference of the minimum outer diameter "r1" and the maximum outer diameter "r2" of the elastic member 2*b* ranges from 0.4 mm to 3.0 mm. In addition, the range in which a good quality image was formed and no wrinkle was formed in all of the types A to I was that the difference between the minimum outer diameter "r1" and the maximum outer diameter "r2" of the elastic member 2*b* ranges 0.4 mm to 2.0 mm.

In this manner, the elastic member 2*b* having an outer diameter difference of at least 0.2 mm or more is formed, whereby, even in the case where heat expansion occurred due to heating, a good image was successfully formed because a desired nip width can be allocated. Further, if the hardness is low, much air is contained in the elastic member 2*b*. In addition, even if the hardness is kept unchanged, much air is contained in the elastic member 2*b* concurrently if the thickness is increased. Thus, an amount of heat expansion is increased due to heating, and the elastic member 2*b* having low hardness becomes greater than the heating member 2*b* having low hardness. Therefore, in some samples, although a good quality image was not formed in an outer diameter difference of 0.2 mm, a good quality image was successfully formed by allocating an outer diameter difference of 0.4 mm or more.

As described above, in the elastic member 2*b*, a good quality image is formed and no paper wrinkle is formed as long as the difference between the minimum outer diameter "r1" and the maximum outer diameter "r2" is within the range of at least 0.4 mm or more and 2.0 mm or less. By changing the hardness and thickness, the elastic member 2*b* having a difference between the minimum outer diameter "r1" and the maximum outer diameter "r2" ranging from 0.2 mm to 3.0 mm can be utilized.

In this manner, a good quality image can be formed and no paper wrinkle can be formed.

In the case where the heat roller 2 was produced by using the elastic member 2*b* having hardness which is smaller than 25 degrees and which is greater than 45 degrees, the heat roller having no required function satisfied was successfully produced.

Further, the heat roller 2 has surface hardness which is different from that during non-heating. In more detail, the surface hardness during heating is higher than that during non-heating. As is evident from a result of "hardness change test by heating" shown in FIG. 4, the surface hardness was higher by 9 degrees at maximum. In the "hardness change test by heating" shown in FIG. 4, samples of the elastic members 2*b* are prepared, the elastic members having 0 mm, 0.8 mm, 1.0 mm, 1.6 mm, and 2.0 mm, respectively, in outer diameter difference between the minimum outer diameter "r1" and the maximum outer diameter "r2", and the hardness before these samples are heated by the heating device 6 (hardness during non-heating) and the hardness after heated (hardness during heating) were measured. The hardness after heated denotes the surface hardness of the heat roller 2 measured when the heat roller 2 is heated by the induction heating device 7 while the heat roller 2 is rotated, and then, the heat roller 2 becomes 180° C. which is a fixing temperature.

As shown in FIG. 4, the surface hardness during non-heating and the surface hardness during heating were the highest in the case where the outer diameter difference was 0 (zero), and the surface hardness during each of heating and non-heating was lowered with an increase in outer diameter difference. In addition, the surface hardness during heating was the highest in the case where the outer diameter difference was 0 (zero), and a substantially identical change occurred during non-heating and during heating in the case where the outer diameter difference is 1.6 mm, or 2.0 mm. The pressure roller 3 has higher surface hardness than that during heating of the heat roller 2.

This is because there is a difference in heat expansion coefficient among the elastic member 2*b*, the metal conductive layer 2*c*, the second elastic layer 2*d*, and the mold release layer 2*e* (hereinafter, referred to as an conductive layer laminate) and the expanded elastic member 2*b* pushes up the conductive layer laminate.

The center portion 2*b* includes a paper passing region fixed as a region through which the paper Q transported between the heat roller 2 and the pressure roller 3 passes. Thus, a length D1 in the axial direction of the center portion 21*b* has a length which is greater than at least the paper passing region. In the embodiment, the length D1 in the axial direction of the center portion 21*b* is, for example, 310 mm which is slightly greater than a length (297 mm) of one shorter edge of paper of A3 size. Incidentally, if a stepped portion at the boundary between the center portion 21*b* and the end portion 22*b*, 23*b* exists in the paper passing region, a pressure applied to the paper Q passing through the paper passing region partially concentrates, and an image failure or a paper wrinkle may occur.

The hardness of the elastic member 2*b* shown in FIG. 3 is measured by an ASKAR-type Durometer specified by a hardness testing method for a sulfur-added rubber and a thermal plasticity rubber conforming to JIS6253-1997.

SECOND EMBODIMENT

Now, with reference to FIGS. 5 and 6, another example of a heat roller applied to the heat roller 2 shown in FIG. 1 will be described in detail. FIG. 5 is a schematic perspective view showing a heat roller 2 which can be applied to the present embodiment. FIG. 6 is a sectional view of the heat roller 2 shown in FIG. 5.

As shown in FIGS. 5 and 6, the heat roller 2 comprises: a shaft member 2*a*; an elastic member 2*b*; an elastic member 2*b*; an electrically conductive layer laminate 2*cde* which includes a metal conductive layer 2*c*, a second elastic layer 2*d*, and a mold release layer 2*e*; and a filter 2*f*.

The conductive layer laminate 2*cde*, as shown in FIG. 6, has a length in the longitudinal which is slightly greater than that of the elastic member 2*b*, and slightly protrudes from both ends of the elastic member 2*b*.

The filter 2*f* is allocated at both ends of the elastic member 2*b*, and is bonded with each of the shaft member 2*a* and the conductive layer laminate 2*cde* by means of a benzene nuclei (benzene ring)-free adhesive 2*s*. Therefore, the elastic member 2*b* is sealed by the shaft member 2*a*, the conductive layer laminate 2*cde*, and the filter 2*f*. As this filter 2*f*, a filter capable of removing toxic gas represented by benzene or the like can be utilized.

In this manner, even in the case where the heat roller 2 is heated by the induction heating device 5, and a toxic gas occurs from the elastic member 2*b*, such a toxic gas cannot pass through the filter 2*f*, and the toxic gas-free air is discharged to the outside.

Since the adhesive agent 2*s* is also a benzene nuclei-free adhesive agent, no toxic gas occurs even if heating is carried out.

Accordingly, a fixing apparatus which a user can be reliably utilize can be provided.

As described above, in order to prevent toxic gas from occurring from the elastic member 2*b*, the elastic member may be composed of a foam rubber produced by foaming, for example, a dimethyl silicon rubber as a silicon rubber which does not contain benzene nuclei in molecular skeleton. The dimethyl silicon rubber does not generate a toxic gas represented by benzene even in the case where the rubber is heated at a high temperature of 100° C. or higher as shown in the present embodiment.

Therefore, there can be provided a fixing apparatus which the user can reliably utilize without a toxic gas being discharged to the outside.

It is preferable that a benzene nuclei-free agent is used as a foaming agent, a cross-linking agent, an additive and the like when manufacturing a foam rubber of the elastic member 2*b*.

The present invention is not limited to the above-described embodiments. The present invention can be embodied by modifying constituent elements without departing from the spirit of the invention at the stage of embodiments. In addition, a variety of inventions can be formed by using a proper combination of a plurality of constituent elements disclosed in the above embodiments. For example, some of all the constituent elements disclosed in the embodiments may be erased. Further, the constituent elements over the different embodiments may be properly combined with each other.

What is claimed is:

1. A heat roller comprising:

an elastic member formed in a cylindrical shape and having a difference between a maximum outer diameter and a minimum outer diameter ranging from 0.2 mm to 3.0 mm, hardness of the elastic member ranging from 25 degrees to 45 degrees in measurement by Durometer E type; and a conductive layer allocated outside of the elastic member.

2. A heat roller according to claim 1, wherein the elastic member includes a center portion having the minimum outer diameter and end portions allocated at both ends of the center portion, the end portions each having the maximum outer diameter, and a thickness of the end portion is equal to or greater than 5.0 mm, and the maximum outer diameter and the minimum outer diameter have a difference therebetween ranging from 0.2 mm to 3.0 mm.

3. A heat roller according to claim 1, wherein the conductive layer further has a mold release layer integrally formed at an outer periphery thereof, or the like.

4. A heat roller according to claim 1, wherein the elastic member includes at least a dimethyl silicon rubber.

5. A heat roller comprising:

an elastic member formed in a cylindrical shape and allocated on an outer periphery face of a shaft member;

a conductive layer allocated on an outer periphery face of the elastic member; and a filter allocated at both ends in an axial direction of the elastic member, the filter sealing the elastic member together with the shaft member and the conductive layer.

6. A heat roller according to claim 5, wherein the filter is an active carbon filter.

7. A heat roller according to claim 5, wherein the filter is bonded with the shaft member and the conductive layer by means of a benzene-free adhesive.

8. A fixing apparatus comprising:

a heat roller which includes: an elastic member including a center portion having a minimum outer diameter and end portions allocated at both ends of the center portion, the end portions each having a maximum outer diameter; and a conductive layer allocated on an outer periphery face of the elastic member, surface hardness during heating and surface hardness during non-heating being different from each other;

a pressure roller pressed against the heating roller by a pressurizing mechanism; and a heating mechanism which utilizes inductive heating to heat the conductive layer.

9. A fixing apparatus according to claim 8, wherein, in the heat roller, the surface hardness during heating is higher than the surface hardness during non-heating.

10. A fixing apparatus according to claim 8, wherein surface hardness of the pressure roller is higher than the surface hardness during heating of the heat roller.

* * * * *